United States Patent [19]

Costa

[11] Patent Number: 4,586,321

[45] Date of Patent: May 6, 1986

[54] APPARATUS FOR AUTOMATICALLY INSERTING TRANSPARENCIES INTO ONE PIECE FRAMES

[75] Inventor: Gianluigi Costa, Valdagno, Italy

[73] Assignee: Tecnodia, s.r.l., Valdagno, Italy

[21] Appl. No.: 539,798

[22] Filed: Oct. 7, 1983

[30] Foreign Application Priority Data

Oct. 8, 1982 [IT] Italy ..... 84144 A/82

[51] Int. Cl.[4] ..... B65B 63/00

[52] U.S. Cl. ..... 53/520; 53/266 R

[58] Field of Search ..... 53/266 C, 266 R, 435, 53/520, 52 L; 156/108, 202, 212, 514

[56] References Cited

U.S. PATENT DOCUMENTS

| | | | |
|---|---|---|---|
| 3,194,709 | 7/1965 | Bondhus | 156/108 X |
| 3,780,608 | 12/1973 | Brown | 156/514 X |
| 3,816,219 | 6/1974 | Hurlbut et al. | 156/514 X |
| 3,992,243 | 11/1976 | Berggren et al. | 156/108 X |
| 4,004,340 | 1/1977 | Urban | 53/435 X |
| 4,256,527 | 3/1981 | Green | 156/108 X |

*Primary Examiner*—John Sipos
*Assistant Examiner*—Steven P. Weihrouch
*Attorney, Agent, or Firm*—Kimmel, Crowell & Weaver

[57] ABSTRACT

The apparatus for automatically inserting transparencies into one-piece frames, comprises:

a feeder for the open frames (10), which are withdrawn one by one from a store (33) and fed along a sliding surface (7) towards a gripper (26), a feeder for the film (20), which is fed along a sliding surface (19) aligned with the sliding surface (7) for the frames (10), but in the opposite feed direction to these latter, a cutter (18) positioned at the front end of the sliding surface (19) for the film (20) in order to cut transparencies, a gripper (26) interposed between the sliding surface (7) for the open frames (10) and the sliding surface (19) for the film (20) and which is provided with a fixed jaw (27) and a mobile jaw (27'), and is movable orthogonally to the feed direction of the frames and film between a waiting position, in which it is open in order to receive the frame and transparency, and a working position in which after being closed, it retains the lower half frame of the frame (10) and the transparency and conveys them to a frame closure device.

7 Claims, 11 Drawing Figures

FIG,1

APPARATUS FOR AUTOMATICALLY INSERTING TRANSPARENCIES INTO ONE PIECE FRAMES

BACKGROUND OF THE INVENTION

This invention relates to an apparatus for automatically inserting transparencies into one-piece frames.

Known diapositives comprise a transparency obtained generally from film, and a square frame of standardised outer dimensions provided with a window for the transparency. Each frame, which for special requirements can be of cardboard, but is normally of plastics construction, is formed from two half frames which are joined together to retain the interposed transparency.

A known type of frame for diapositives comprises two half frames joined together along three sides and free along the fourth side, to thus form a type of "envelope". Suitable apparatus resiliently separates the facing sides of the two half frames by 1 or 2 mm, and inserts the transparency through the aperture formed in this manner. This insertion, which is obviously only partial, is completed by a suitable gripper which then grips the transparency through the window of the two half frames and drags it until it is centered with respect to them.

A drawback of this known type of frame is that the smallness of the insertion aperture can cause slippage of the transparency, which is not always prefectly flat but is often slightly curved. A further drawback is that the gripper which completes the insertion and centering of the transparency between the two half frames operates against the surface of the transparency and can damage it.

Another known type of transparency frame comprises two separate half frames, of which one is provided with adhesive points to which the transparency is made to adhere. The second half frame is then joined to the first by snap-insertion.

A drawback of this design is that the transparency remains permanently soiled by the adhesive and can no longer be used for other processes (duplication, printing etc.) for which it would have to be removed from the frame. A further drawback is that the existence of two separate pieces (half frames) results in increased difficulty in joining them together.

A frame is also known formed from two half frames which are hinged together along an adjacent side and can be "closed" in order to retain the interposed transparency. The apparatus which automatically effects this insertion is provided with suckers which retain the transparency as the half frames are folded over and snapped together. A drawback of this design is that the transparency is touched by the suckers on insertion, and can therefore be damaged.

SUMMARY OF THE INVENTION

The object of the invention is to provide a machine which automatically inserts transparencies into frames of foldable type but in contrast to known machines for this use, does not touch that part of the transparency reserved to the image and therefore does not damage it, which is of simpler construction and operation, which operates at a high rate of operation, and which ensures that the transparency is kept perfectly centered from the instant it rests on the frame until this latter is closed.

This object is attained according to the invention by an apparatus for automatically inserting transparencies into one-piece frames, characterised by comprising:

a feeder for the open frames, which are withdrawn one by one from a store and fed along a sliding surface towards a gripper, a feeder for the film, which is fed along a sliding surface aligned with the sliding surface for the frames, but in the opposite feed direction to these latter, a cutter positioned at the front end of the film sliding surface in order to cut the transparencies, a gripper interposed between the sliding surface of the open frames and the sliding surface for the film and which is provided with a fixed jaw and a mobile jaw, and is movable orthogonally to the feed direction of the frames and film between a waiting position, in which it is open in order to receive the frame and transparency, and a working position in which, after being closed, it retains the lower half frame of the frame and the transparency and conveys them to a frame closure device.

Advantageously, the slide can be provided with an appendix guided in a continuous slot provided in a roller which is rotated synchronously with the other operating stages, said slot comprising portions inclined to the roller generating lines to correspond to movements of said slide towards and away from the frame closure device, and portions orthogonal to said generating lines to correspond to halt periods of said slide.

Again according to the invention, the mobile gripper jaw can be provided with elastic means which press it against the fixed jaw, and with an operating appendix which slides on the base of a continuous slot of variable depth provided in the roller, parallel to the preceding slot.

BRIEF DESCRIPTION OF THE DRAWINGS

A preferred embodiment of the present invention is described hereinafter with reference to the accompanying drawings in which.

DESCRIPTION OF THE PREFERRED EMBODIMENT

Figure 1:
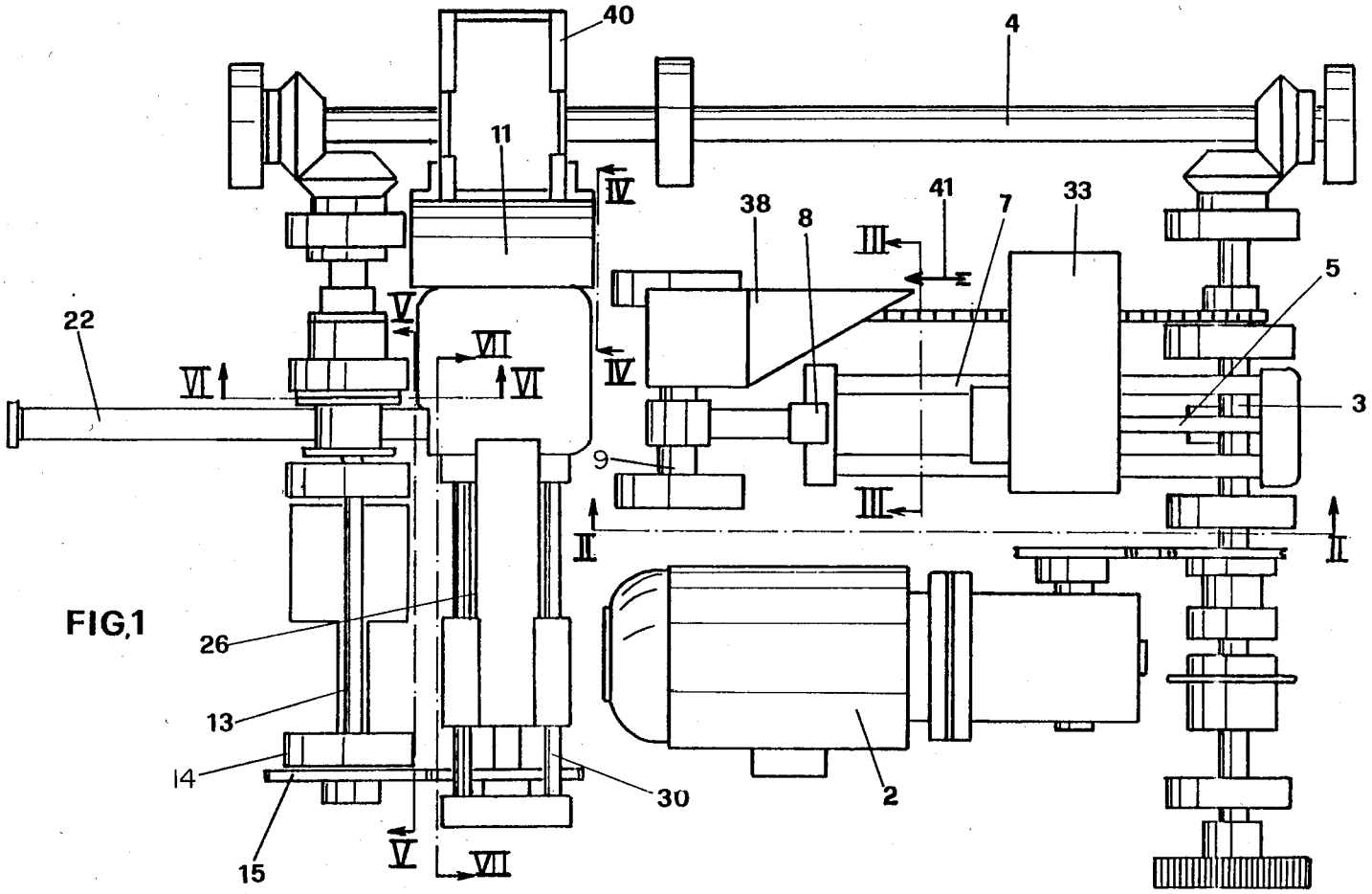
FIG. 1 is an overall diagrammatic plan view of the apparatus according to the invention.
Figure 2:
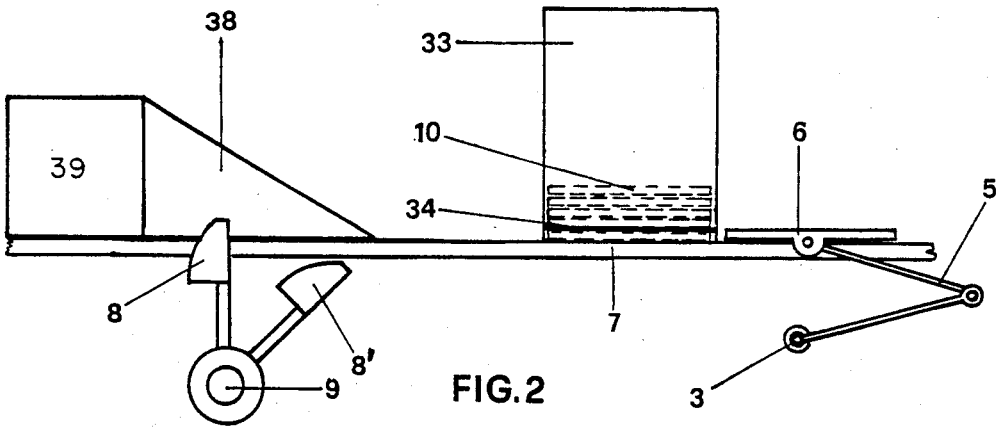
FIG. 2 is a vertical section on the line II—II of FIG. 1.
Figure 3:
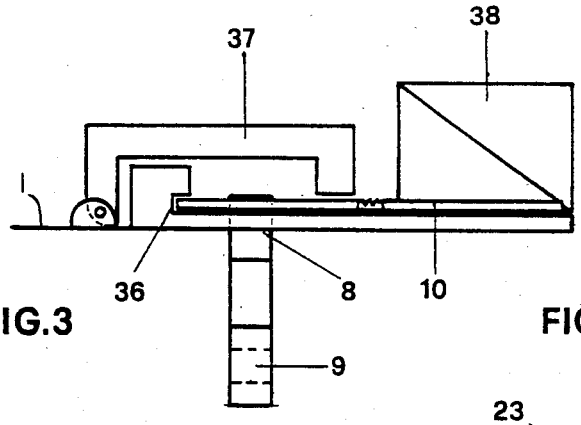
FIG. 3 is a vertical cross-section on the line III—III of FIG. 1.
Figure 4:
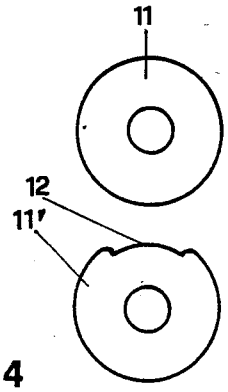
FIG. 4 is a cross-section through the closure rollers on the line IV—IV of FIG. 1.
Figure 5:
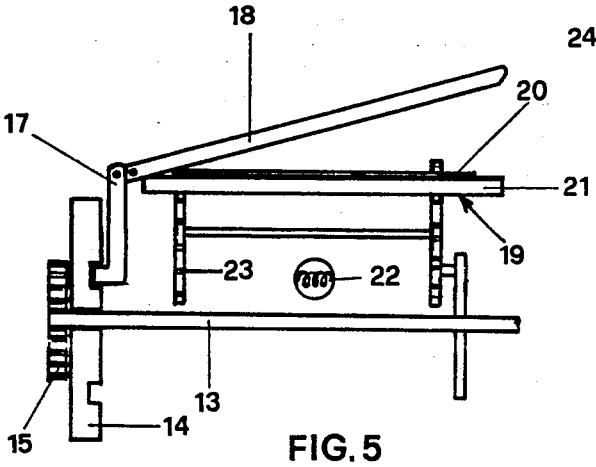
FIG. 5 is a cross-section through the cutter operating arm on the line V—V of FIG. 1.
Figure 6:
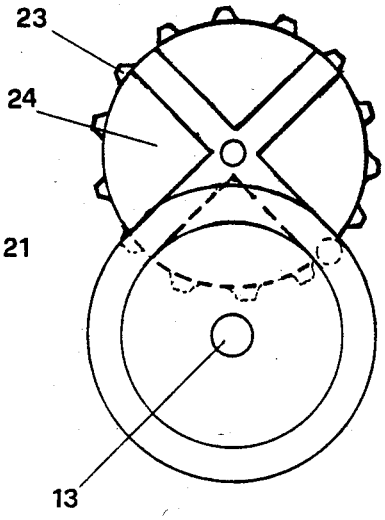
FIG. 6 is a section through the film feed sprocket on the line VI—VI of FIG. 1.
Figure 7:
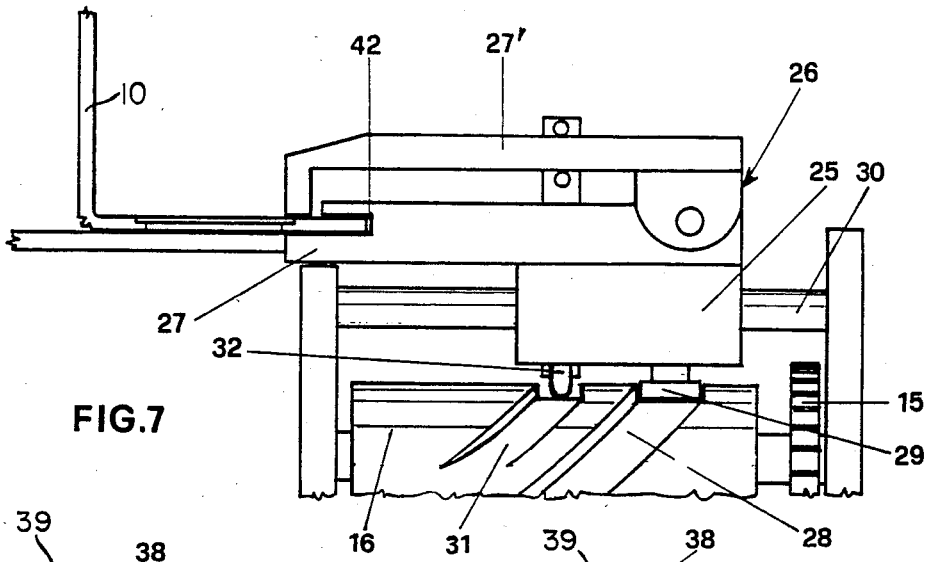
FIG. 7 is a side view of the gripper of the apparatus according to the invention, on the line VII—VII.
Figure 8:
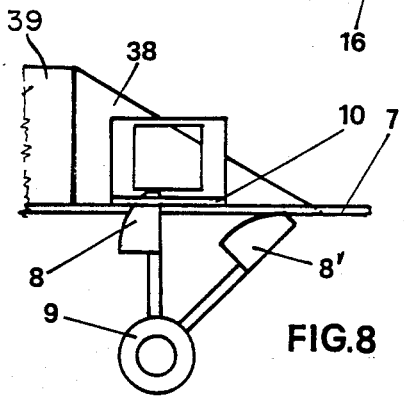
FIGS. 8 and 9 show two successive stages in the advancement of the positioning fingers.
Figure 9:
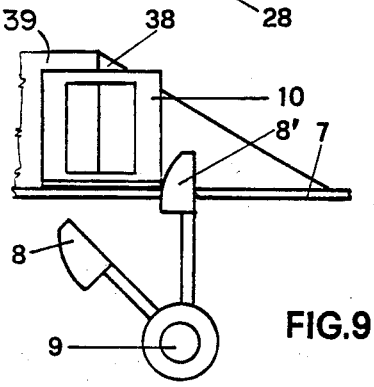
Figure 10:
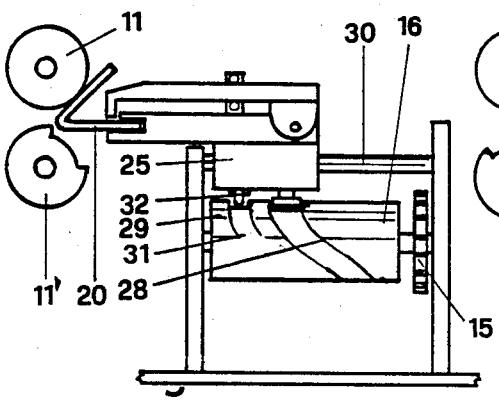
FIGS. 10 and 11 show two stages in the operation of the gripper of the apparatus according to the invention, the stages being subsequent to that shown in FIG. 7.
Figure 11:
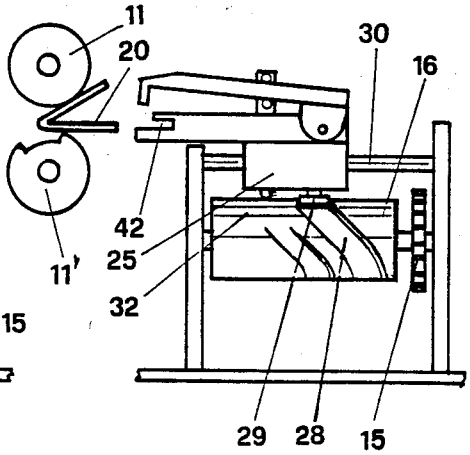

As can be seen from the figures, the apparatus according to the invention comprises a base 1 on which there is mounted an electric motor 2 which drives a crankshaft 3 and, by way of bevel gearing, a longitudinal shaft 4. A connecting rod 5 is coupled to the crank 3 to operate with reciprocating motion a slide 6 slidable along a sliding surface 7.

In a position corresponding with the rear end-of-troke position of the slide 6 there is provided a store 33 or a pile of open frames 10. Said store is provided at its ront with a lower slot 34 from which the individual rames can be extracted one by one and pushed along he sliding surface 7. This sliding surface is bounded on ne side by a horizontal slot 36 in which one edge of a rame 10 engages, and is open on its other side. It is also rovided with a member 37 which is hinged to the base on the same side as the horizontal slot 36, and is of uch a width as to prevent the half frame rising during he folding stage. To the side of said sliding surface 7 here is also provided a metal block 38 of substantially yramidal configuration, with its point facing the store 3. Its function is to cause that half frame of the frame 0 which is not retained by the slot 36 to rotate progresively until it becomes disposed at 90° to the other half rame, and it remains in this configuration by resting gainst the vertical side wall 39 of said pyramidal elenent 38.

At the opposite end of the sliding surface 7 to the onnecting rod 5 there are provided two positioning ingers 8 and 8'. They are constituted by two radial arms nounted on the same shaft 9, which is rotated by the rankshaft 3. The angle formed by the two arms of the ositioning fingers 8 and 8' is related to the dimensions f the frame 10, and also to the distance of the axis of the haft 9 from the sliding surface 7, as will be more apparnt from the description of operating of the apparatus.

Parallel to the longitudinal shaft 4 there are provided wo vertically superposed rollers 11,11' of equal diameer. The upper roller 11 has its surface perfectly cylinlrical, while the lower roller 11' comprises over its ntire width a recess 12 of depth just greater than the hickness of the finished frame. The two rollers 11,11' re coupled together in such a manner as to rotate in pposite directions at the same angular speed, and are lriven by the longitudinal shaft 4. Externally to said ollers 11,11', with reference to their direction of rotaion, there is provided a store 40 which faces them. Its urpose is to receive the frames one after another after hey have been snap-closed.

The longitudinal shaft 4 is also connected by way of evel gearing to a transverse shaft 13 on which there is eyed a cam 14, and which is connected by way of earing 15 to a slotted roller 16. With the cam 14 there s associated an operating arm 17 of a cutter 18 which perates on a sliding surface 19 for the film 20 to be cut nto transparencies. The sliding surface 19 is disposed ubstantially as a prolongation of the sliding surface 7 or the open frames 10, and is spaced apart from the atter surface by a distance which is sufficient, as will be een hereinafter, to allow the reciprocating movement f a gripper for inserting the folded frame between the losure rollers 11 and 11'.

The sliding surface 19 for the film 20 is constituted by milk glass plate 21, below which a lamp 22 is provided or illuminating the film 20. At that end of the sliding urface 19 close to the cutter 18 there is provided a procket 23 having its pitch equal to the perforation itch of the film 20. It is driven with intermittent motion orresponding to the length of one transparency by the ransverse shaft 13 by way of a conventional Maltese ross coupling 24.

Above the slotted roller 16 there are provided two arallel guides 30, along which there slides a slide 25 for upporting a gripper 26, the jaws of which face the ollers 11,11'. The lower jaw 27 of the gripper 26 is rigid with the slide 25, whereas the upper jaw 27' is hinged to the jaw 27 and is mobile relative thereto in a vertical plane.

In the lateral surface of the roller 16 there is provided a first continuous slot 28 of constant depth, in which a pin 29 rigid with the slide 25 slides. This slot comprises orthogonal portions and portions which are inclined to the cylindrical surface generating lines. As will be apparent hereinafter, on rotation of the roller 16, the inclined portions produce movements of the slide along the guides 30 in one or other direction, while the orthogonal portions produce halt periods of said slide 25. Parallel with and to the side of the slot 28 there is provided a further slot 31 of variable depth. On the base of this latter slot there rests the end of an appendix 32 rigid with the mobile upper jaw 27' of the gripper 26. When the depth of the slot 31 is a minimum, the appendix 32 keeps the jaw 27' raised and thus the gripper 26 open, whereas when the depth of the slot 31 is a maximum, the spring keeps the jaw 27' resting against the jaw 27, and thus the gripper 26 elastically closed.

Before describing the operation of the apparatus according to the invention, it should be noted that the sizing of the various parts and the setting-up of the apparatus must be such as to ensure perfect synchronism between its various members. In the description of operation, the path of a single frame is described, although it is apparent that the operations are cyclic in the sense that while one member performs a certain operation on said frame, other members perform other operations on the preceding and/or following frame.

If the initial instant is assumed to be that in which the slide 6 is in its rear end-of-stroke position (beyond the store 33), then from that instant the operation of the apparatus according to the invention is as follows: when the crankshaft 3 is rotated by the electric motor 2, it moves the slide 6 along the sliding surface 7 in the direction of the arrow 41 of FIG. 1. As this slide is located at a level just above the sliding surface 7 for the open frames 10, the lower frame of the pile also advances with the slide and after passing through the slot 34 of the store 33, the left hand edge of its left hand half frame becomes inserted into the guide slot 36 of the sliding surface 7, and it is made to remain adhering to the sliding surface by means of the guiding action on the right hand edge of said half frame exerted by the member 37. During this stage, the right hand half frame, which is free, encounters the pyramidal block 38, and is progressively rotated until it becomes disposed substantially at 90°, in a position ready for closure. When the slide 6 has come close to its front end-of-stroke position, the front positioning finger 8 has already entered the window of the horizontal half frame of the frame 10, and is thus able to continue to cause it to advance by pushing against the inner edge of its front side while at the same time keeping it inserted in the slot 36 by way of its left hand edge. As the advancement of the frame 10 continues, the front positioning finger 8 slides lowerly along said edge, and simultaneously the rear positioning finger 8' rests on the outer edge of the rear side of the half frame to continue the thrust action in order to cause the frame 10 to advance. During this stage, the gripper 26 is in its open configuration in its rear end-of-stroke position, and the positioning finger 8' is able to push the frame 10 so that the left hand edge of its left hand half frame enters a slot 42 provided in the fixed jaw 27 as a prolongation of the horizontal slot 36. As soon as the frame 10 has reached this position, the film 20 is fed through one transparency, and immediately afterwards the cam 14 operates the cutter 18 which separates the transparency and causes it to fall on to the horizontal half frame of the frame 10. Then by a succession of movements established during the design and setting-up of the machine, the slotted roller 16 firstly operates the mobile jaw 27', which is lowered on to the fixed jaw 27 to grip the horizontal half frame and the overlying transparency along its lateral perforated edge, and to advance it in this gripped condition towards the rollers 11,11'. As the frame advances, its upper half frame becomes increasingly folded towards the lower half frame, but because the lower roller 11' has its recess 12 facing the roller 11 during this stage, the distance between the two facing surfaces is such that the two rollers exert no dragging action on the frame 10. When the gripper 26 is in proximity to its front end-of-stroke position, the lower roller 11' is close to presenting its entire lateral surface to the upper roller 11, but the extent of folding of the upper half frame of the frame 10 is already such that said roller presses the transparency so that it becomes clamped against the lower half frame. At this point, the effect of the slots 28 and 31 is such that at the moment in which the two rollers 11 and 11' grip the frame 10 between them, the gripper 26 abandons it and returns to its initial rear end-of-stroke position. As they rotate, the two rollers 11 and 11' drag the frame 10 and at the same time snap the two half frames together into a closed state with the transparency interposed.

The finished frame is then discharged from the rollers 11 and 11' to the store 40, from the side opposite the inlet side.

From the aforegoing, it is apparent that the apparatus according to the invention has numerous advantages, and in particular:

it operates with one-piece frames, so ensuring high accuracy during their closing;

it does not touch that part of the transparency reserved to the image, and therefore does not damage it;

it folds the frame during its feed, so enabling high production rates to be attained;

it holds the transparency continuously against the frame from the moment it is applied until the frame is closed, so ensuring constant and perfect relative positioning.

I claim:

1. An apparatus for automatically inserting transparencies into open one-piece plastics frames and for folding said frames to enclose said transparencies, characterized by comprising:

a feeder for the open frames (10) said frames comprising first and second half frame portions joined at a hinge, which are withdrawn one by one from a store (33) said first and second half frame portions being in the same plane in said store and moved toward a gripper (26) along a sliding surface (7) comprising a horizontal guide slot (36) for an outer edge of said first half frame which is parallel to that edge at which it is hinged to the other half frame, and a member (37) acting on a second edge of the first half frame in order to prevent it rising during the folding stage, a deviator element (38) positioned alongside the sliding surface (7) and on the same side as the free second half frame and partially interfering with said second half frame during the frame feed, to cause it to rotate about the axis along which it is hinged to the first half frame, and to thus dispose it in a position suitable for the closure of said frame, a feeder for the film (20), including a sliding surface (19) along which the film is fed and which is at a level above and aligned with the sliding surface (7) for the frames (10), the direction of feed of said film being opposite to the direction of feed of the frames, said feeder for the film feeding a portion of the film to project past the downstream end of said film sliding surface, a cutter (18) positioned at the downstream end of the sliding surface (19) for the film (20) in order to cut projecting transparencies and to drop them onto respective first half frames, a closure device for folding the second half frame over and onto the transparancy and first half frame to enclose the transparency, a gripper (26) interposed between the sliding surface (7) for the open frames (10) and the sliding surface (19) for the film (20) and which is provided with a fixed jaw (27) and a mobile jaw (27'), means for moving said gripper orthogonally to the feed direction of the frames and film from a waiting position to a working position and then further to the closure device, means for opening said gripper to receive said frame and transparency at said waiting position and for closing said gripper to retain the first half frame of the frame (10) and the transparency and to convey them to a frame closure device.

2. An apparatus as claimed in claim 1 characterized in that the member (37) is hinged parallel to the sliding surface (7) for the frames (10), but on the opposite side to the free half frame, said member (37) being raisable to allow inspection of said sliding surface (7).

3. An apparatus as claimed in claim 1, characterized by comprising, substantially at the front end of the frame sliding surface (7), a pair of positioning fingers (8,8') mounted on a shaft (9) rotating in synchronism with the other operational stages, one positioning finger (8) being insertable into the window of the half frame constrained to the sliding surface in order to cause it to advance when the thrust action of the slide (6) ceases, the other positioning finger (8') being able to be brought against the rear edge of said half frame in order, after the first finger (8) has again left the window of the half frame, to continue the thrust action until the edge of the half frame which is constrained to the sliding surface is inserted into a slot (42) provided in the fixed jaw (27) of the gripper (26) along the prolongation of the slot (36).

4. An apparatus as claimed in claim 1, characterized in that the fixed jaw (27) of the gripper (26) is mounted on a slide (25) driven with reciprocating motion in synchronism with the other operational stages, the mobile jaw (27') being hinged to the fixed jaw (27) and operated automatically in accordance with the position of the slide (25).

5. An apparatus as claimed in claim 4, characterized in that the silde (25) is provided with an appendix (32) guided in a continuous slot (31) provided in a roller (16) which is rotated synchronously with the other operating stages, said slot (31) comprising portions inclined to the generating lines of the roller (16) to correspond to movements of said slide (25) toward and away from the frame closure device, and portions orthogonal to said generating lines to correspond to halt periods of said slide.

6. An apparatus as claimed in claim 5 characterized in that the mobile jaw (27') of the gripper (26) is provided with elastic means pressing it against the fixed jaw (27), and with an operating appendix (32) sliding on the base of a continuous slot (31) of variable depth which is provided in the roller (16) parallel to the slot (28).

7. An apparatus as claimed in claim 1, characterized in that the frame closure device comprises a pair of rollers (11,11') facing the gripper (26), at least one of said rollers comprising a recess (12) of depth slightly greater than the frame thickness, and of circumferential extension such as to delay the gripping effect on the almost completely folded-over frame until the instant of stoppage and opening of the gripper (26).

* * * * *